US010327560B2

(12) United States Patent
Angle et al.

(10) Patent No.: US 10,327,560 B2
(45) Date of Patent: Jun. 25, 2019

(54) CONVERTIBLE SOFA WITH ARTICULATED ARM RESTS

(71) Applicant: LIPPERT COMPONENTS, INC., Elkhart, IN (US)

(72) Inventors: Shannon Angle, Nappanee, IN (US); Adalberto Collazo, Millersburg, IN (US)

(73) Assignee: LIPPERT COMPONENTS, INC., Elkhart (IN)

( * ) Notice: Subject to any disclaimer, the term of this patent is extended or adjusted under 35 U.S.C. 154(b) by 379 days.

(21) Appl. No.: 15/009,046

(22) Filed: Jan. 28, 2016

(65) Prior Publication Data

US 2016/0213156 A1 Jul. 28, 2016

Related U.S. Application Data

(60) Provisional application No. 62/153,786, filed on Apr. 28, 2015, provisional application No. 62/108,729, filed on Jan. 28, 2015.

(51) Int. Cl.
*A47C 17/18* (2006.01)
*A47C 17/175* (2006.01)

(52) U.S. Cl.
CPC ..... *A47C 17/1756* (2013.01); *A47C 17/18* (2013.01)

(58) Field of Classification Search
CPC ..... A47C 17/00; A47C 17/12; A47C 17/16; A47C 17/162; A47C 17/17; A47C 17/175; A47C 17/1756; A47C 17/18
See application file for complete search history.

(56) References Cited

U.S. PATENT DOCUMENTS

| | | | | | |
|---|---|---|---|---|---|
| 1,442,197 | A | | 1/1923 | Turner | |
| 1,581,994 | A | | 4/1926 | Duncan | |
| 2,209,880 | A | * | 7/1940 | Fox | A47C 17/1756 16/357 |
| 2,435,936 | A | * | 2/1948 | Wilson | A47C 17/1756 5/47 |
| 2,444,230 | A | * | 6/1948 | Miller | A47C 17/1756 16/277 |
| 2,447,683 | A | * | 8/1948 | Boiu | A47C 17/1756 5/47 |
| 2,567,263 | A | * | 9/1951 | Wilson | A47C 17/1756 16/333 |
| 2,601,683 | A | * | 7/1952 | Bebry | A47C 17/1756 16/287 |
| 2,629,883 | A | * | 2/1953 | Nowell | A47C 17/1756 16/302 |
| 2,694,814 | A | * | 11/1954 | Doner | A47C 17/1756 297/354.13 |
| 2,736,367 | A | * | 2/1956 | Spound | A47C 17/1756 267/84 |
| 3,657,747 | A | * | 4/1972 | Rogers, Jr. | A47C 17/1756 5/29 |

(Continued)

*Primary Examiner* — Nicholas F Polito
*Assistant Examiner* — Myles A Throop
(74) *Attorney, Agent, or Firm* — Nixon & Vanderhye P.C.

(57) ABSTRACT

A convertible sofa is convertible between a sofa configuration and a bed configuration. The convertible sofa includes articulated armrests. When the convertible sofa is in a sofa configuration, the arm rests are in an arm rest configuration. When the convertible sofa is in a bed configuration, the arm rests are in a generally flat or horizontal configuration.

17 Claims, 15 Drawing Sheets

(56) References Cited

U.S. PATENT DOCUMENTS

| | | | | |
|---|---|---|---|---|
| 4,048,680 | A * | 9/1977 | Rogers, Jr. | A47C 17/1756 5/12.1 |
| 4,717,169 | A | 1/1988 | Shaffer | |
| 4,944,104 | A * | 7/1990 | Kowalczyk | E01H 5/06 37/231 |
| 6,413,009 | B1 * | 7/2002 | Duckett | E01F 15/083 404/6 |
| 2002/0130535 | A1 * | 9/2002 | Dick | A47C 17/175 297/118 |
| 2002/0130543 | A1 * | 9/2002 | Tsai | A47C 17/18 297/354.13 |
| 2004/0107498 | A1 * | 6/2004 | Maas | A47C 17/1756 5/37.1 |
| 2006/0096027 | A1 * | 5/2006 | Thurow | A47C 17/1756 5/37.1 |

* cited by examiner

CONVERTIBLE SOFA WITH ARTICULATED ARM RESTS

CROSS REFERENCE TO RELATED APPLICATION

This application claims benefit of U.S. Provisional Patent Application Nos. 62/108,729, filed on Jan. 28, 2015, and 62/153,786, filed on Apr. 28, 2015, and incorporates herein by reference the disclosures thereof in their entireties.

BACKGROUND AND SUMMARY OF THE DISCLOSURE

The disclosure is directed to a convertible sofa that can be selectively configured as a sofa and as a bed. More particularly, the disclosure is directed to a convertible sofa having articulated arm rests that are configured as armrests when the convertible sofa is in a sofa configuration and that fold to a generally or relatively flat configuration when the convertible sofa is in a bed configuration.

Convertible sofas having arm rests are known in the art. Such convertible sofas typically have either a pull-out conversion mechanism or a jackknife conversion mechanism. In either case, the armrests typically are fixed. That is, they assume a single configuration regardless of whether the convertible sofa is in a sofa configuration or a bed configuration.

When a typical pull-out convertible sofa is placed in the bed configuration, the resulting sleeping surface is oriented such that the arm rests flank the upper body of a user lying on the sleeping surface. As such, the arm rests may serve as side bolsters when the sofa is in a bed configuration. This may inhibit persons from entering and exiting the bed.

When a typical jackknife convertible sofa is placed in the bed configuration, the resulting sleeping surface is oriented such that the head and feet of a user lying on the sleeping surface are adjacent respective ones of the arm rests. As such, the arm rests may serve as head and foot boards. This may present a problem for taller users whose height exceeds the distance between the arm rests.

Also known are jackknife convertible sofas lacking integral arm rests. Such jackknife convertible sofas may be provided with removable, auxiliary arm rests. Such arm rests typically are made of an upholstered foam material. They can be attached to the convertible sofa when the convertible sofa is in a sofa configuration, and removed from the convertible sofa when it is to be placed in a bed configuration. This may present a problem in that the removable arm rests may clutter the space about the convertible sofa when removed there from. Also, the attachment of the arm rests to the convertible sofa may be complicated and/or unsecure.

DETAILED DESCRIPTION OF THE DRAWINGS

Terms of orientation, for example, front, rear, upper, lower, side, inner, outer, and the like, may be used herein to describe relative orientation of components. Such terms are to be construed in a relative sense, rather than an absolute sense, unless context clearly dictates otherwise.

Figure 4A:
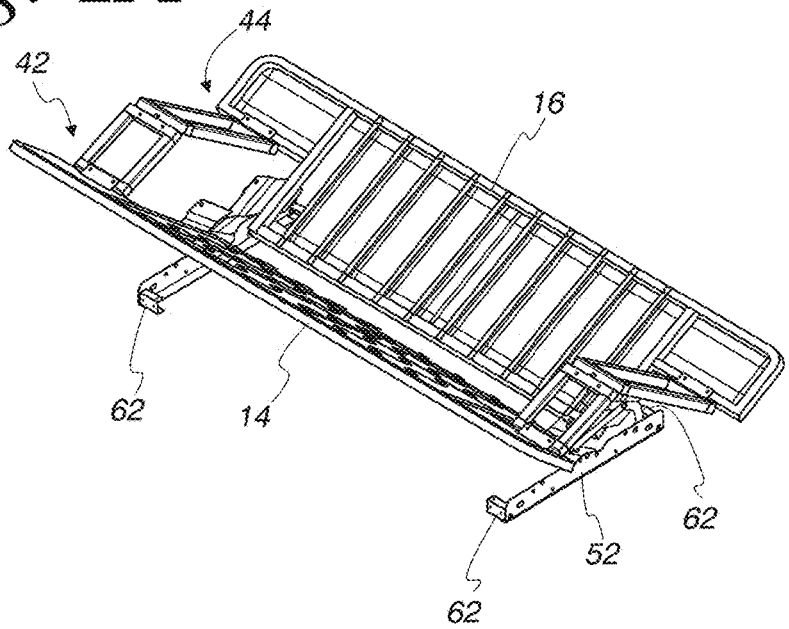
FIG. 4A is a perspective view of an illustrative convertible sofa frame in a third configuration intermediate a sofa configuration and a bed configuration.
Figure 4B:
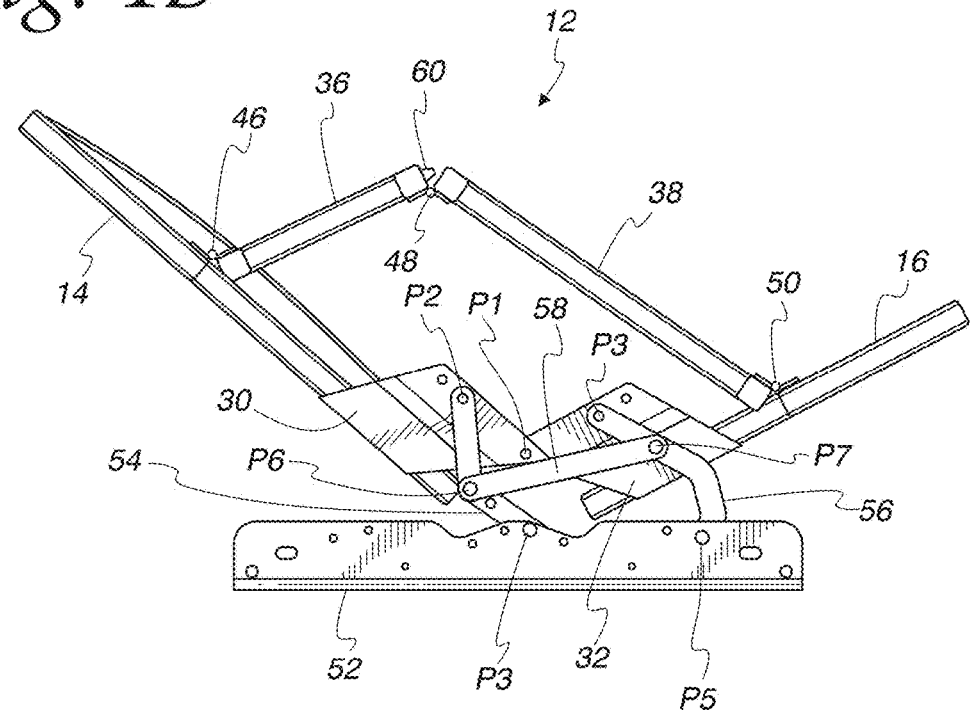
FIG. 4B is a side view of an illustrative convertible sofa frame in a third configuration intermediate a sofa configuration and a bed configuration.
Figure 5A:
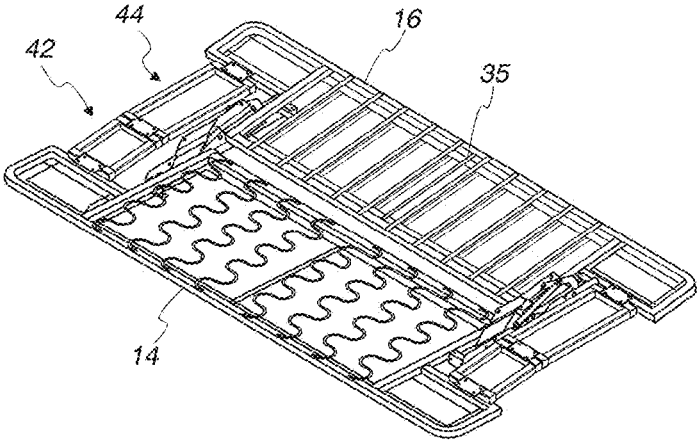
FIG. 5A is a perspective view of an illustrative convertible sofa frame in a bed configuration.
Figure 5B:
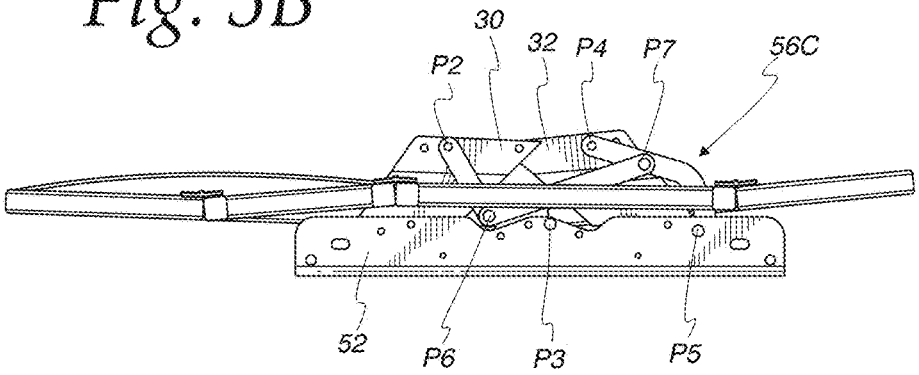
FIG. 5B is a side view of an illustrative convertible sofa frame in a bed configuration.
Figure 6A:
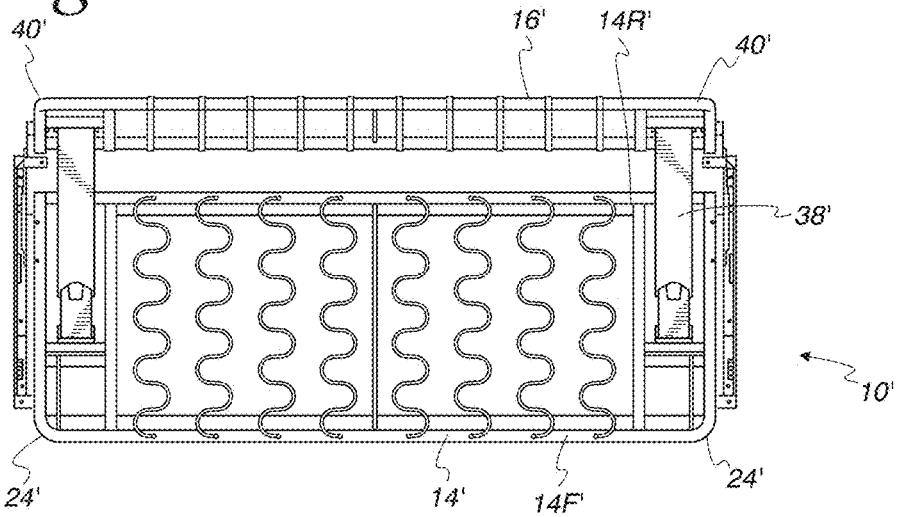
FIG. 6A is a top plan view of another illustrative convertible sofa frame in a sofa configuration.
Figure 6B:
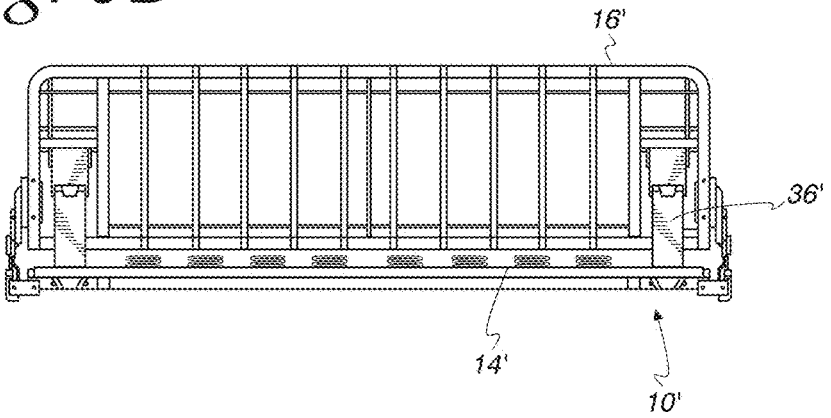
FIG. 6B is a front elevation view of another illustrative convertible sofa frame in a sofa configuration.
Figure 6C:
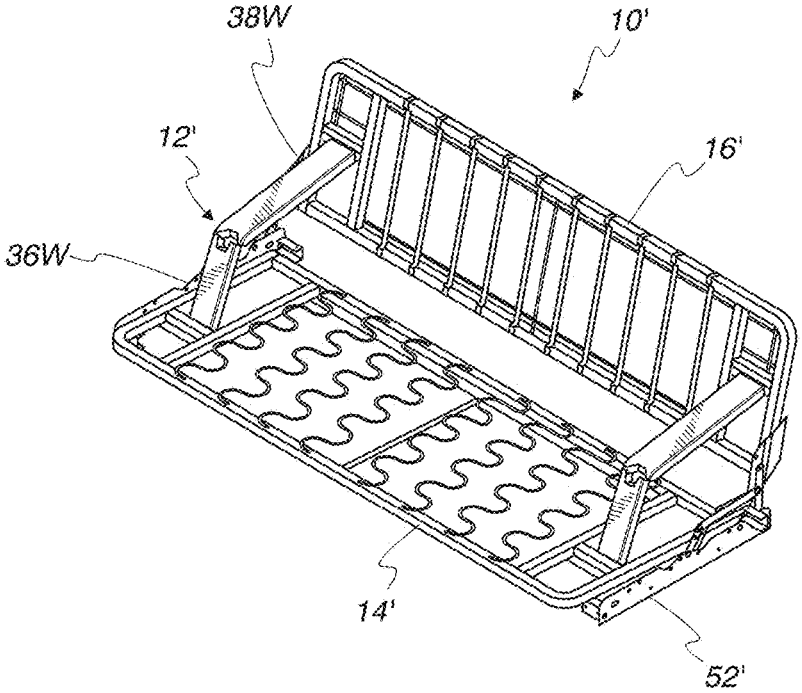
FIG. 6C is a perspective view of another illustrative convertible sofa frame in a sofa configuration.
Figure 6D:
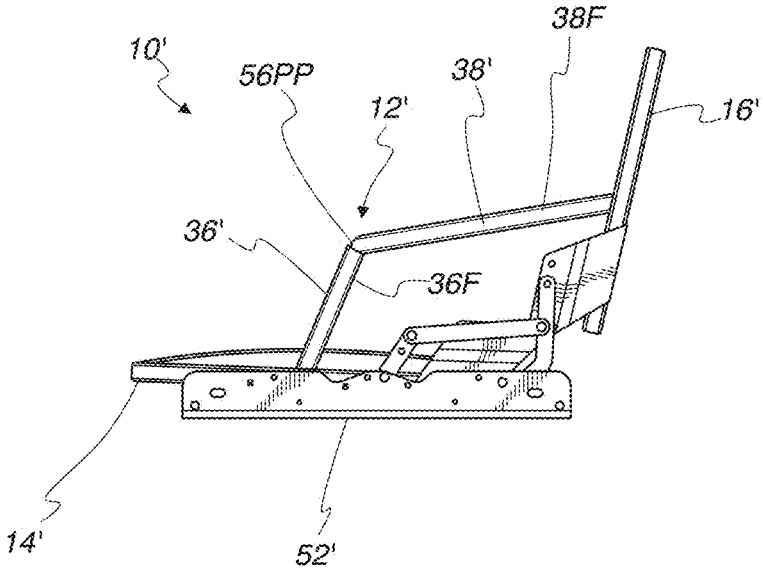
FIG. 6D is an end elevation view of another illustrative convertible sofa frame in a sofa configuration.

FIGS. 1A-5B and 10-11 show an illustrative embodiment of a convertible sofa frame 10 that can be configured in a sofa configuration (see FIGS. 1A and 1B) or a bed configuration (see FIGS. 5A and 5B). The frame 10 includes articulated arm rests 12 that unfold from an armrest configuration (see FIGS. 1A and 1B) when the frame is in a sofa configuration to a generally flat configuration (see FIGS. 5A and 5B) when the frame is in a bed configuration. The frame 10 also includes a seat frame 14 and a back frame 16.

The seat frame 14 includes a central portion having a front rail 14F, a rear rail 14R, and left and right side rails 14S connecting the front rail 14F to the rear rail 14R at or near ends thereof. One or more seat springs 18 are connected to and span the space between the front rail 14F and rear rail 14R of the seat frame 14. The seat springs 18 may form a base for a seat cushion (not shown) that may be disposed thereon. In other embodiments, the seat springs 18 may be connected to and span the space between opposing side rails 14S of the seat frame 14. In either embodiment, the seat springs could be attached to the rails 14F, 14R, 14S in any suitable manner. One(s) of the seat springs 18 could, but need not, be interconnected with another (others) of the seat springs 18.

The seat springs 18 are shown as conventional S-shaped seat springs. In other embodiments, the seat springs 18 could take other forms. Alternatively, the seat springs 18 could be omitted. In embodiments not including seat springs 18, one or more generally rigid cross members (not shown) could span the space between front rail 14F and rear rail 14R or between opposing side rails 14S. Such cross members could be attached to the rails 14F, 14R, 14S in any suitable manner.

In the illustrated embodiment, a crosstie 20 is attached to and extends between the front rail 14F and the rear rail 14R to mitigate or preclude flexing or bowing of the front rail 14F toward the rear rail 14R, for example, in response to a load placed upon the seat springs 18. The crosstie 20 may be generally rigid or incompressible in an axial direction and generally flexible or generally rigid in a transverse direction. In the illustrated embodiment, the crosstie 20 is located midway or about midway between the opposing side rails 14S. In other embodiments, the crosstie 20 could be located nearer one or the other of the side rails 14S. In further embodiments, plural crossties 20 could traverse the space between the front and rear rails 14F, 14R, at any suitable or desired location with respect thereto. First and second longitudinal tie rods 22 similar to the crosstie 20 are attached to and extends between the left and right side rails 14S. In the illustrated embodiment, the first longitudinal tie rod 22 is located near the rear rail 14R, and the second longitudinal tie rod 22 is located near the front rail 14F. In other embodiments, the longitudinal tie rods 22 could be located elsewhere. Other embodiments could include more or fewer longitudinal tie rods 22 located where desired. In an embodiment, any or all of the crossties 20 and longitudinal tie rods 22 could be omitted.

A seat frame extension 24 extends laterally outwardly from each side of the central portion of the seat frame 14. The seat frame extensions 24 may be formed contiguously with one or both of the front and side rails 14F, 14S, or they may formed separately and attached to the central portion of the seat frame 14. The seat frame extensions 24 are shown as generally rectangular, having a front rail 24F, a rear rail 24R and an outboard side rail 24S, and having a rounded outboard front corner where the side rail 24S joins the front rail 24F. In other embodiments, the seat frame extensions 24 could have other shapes. Each seat frame extension 24 is shown as having a crosstie rod 26 attached to and extending between the front rail 24F and the rear rail 24R, proximate the side rail 24S. Each seat frame extension 24 also is shown as including first and second longitudinal tie rods 28 extending from the side rail 24S of the seat frame extension 24 to the corresponding side rail 14S of the central portion of the seat frame 14. The first longitudinal tie rod 28 is near the rear rail 24R and the second longitudinal tie rod 28 is near the front rail 24F. In other embodiments, the seat frame extensions 24 could include more or fewer (or no) cross ties 26 and/or longitudinal tie rods 28. Where included, cross ties 26 and/or longitudinal tie rods 28 could be located where desired.

Figure 10:
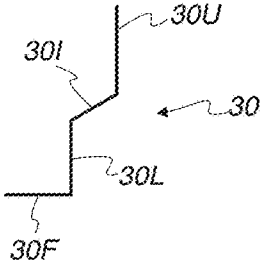
FIG. 10 is an end elevation view of a seat frame bracket of an illustrative convertible sofa frame.
Figure 11:
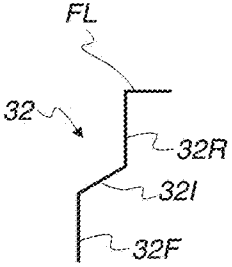
FIG. 11 is an end elevation view of a back frame bracket of an illustrative convertible sofa frame.

A seat frame bracket 30 is attached to each side rail 14S of the central portion of the seat frame 14. The seat frame bracket 30 is shown as a generally diamond-shaped plate which, as best shown in FIG. 10, includes an upper web 30U offset in a laterally outward direction from a lower web 30L by an intermediate web 301. A lower edge of the seat frame bracket 30 runs generally parallel to the axial dimension of the side rail 14S. A flange 30F may extend from the foregoing edge of the seat frame bracket 30 so that the flange and adjoining portion of the lower web 30L of the seat frame bracket "cradle" a corresponding portion of the side rail 14S. In other embodiments, the seat frame bracket 30 could have other configurations.

The back frame 16 includes a central portion including an upper rail 16U, a lower rail 16L, and a pair of opposing left and right side rails 16S. A plurality of stringers 34 extend between the upper rail 16U and lower rail 16L. The stringers 34 are shown as strips, ones of which extend between the upper rail 16U and lower rail 16L along a front side thereof and others of which extend between the upper rail 16U and lower rail 16L along a rear side thereof. In the illustrated embodiment, the stringers 34 are strips of cloth or other fabric wrapped around the upper and lower rails 16U, 16L and spanning the front and rear sides of the back frame 16. The ends of each such piece of cloth or other fabric may be glued or sewn or heat staked together to form a continuous loop of material. Alternatively, each stringer 34 may be a distinct element made of, for example, a cloth, metal, plastic, or other material attached to the upper and lower rails 16U, 16L. In an embodiment, stringers 34 could span only the front or rear side of the back frame 16. In another embodiment, the stringers 34 could be omitted and replaced with panels (not shown) covering substantially larger areas of the front and/or rear sides of the back frame 16.

In the illustrated embodiment, first and second longitudinal tie rods 36 are attached to and extend between the left and right side rails 16S. The first longitudinal tie rod 36 is near the upper rail 16U, and the second longitudinal tie rod 36 is near the lower rail 16L. A crosstie 35 similar to crosstie 20 extends between the upper and lower rails 16U, 16L. Other embodiments could include additional tie rods extending between the side rails 16S or between the upper and lower rails 16U, 16L. Further embodiments could include fewer or no tie rods or crossties in the back frame 16. The back frame crossties and tie rods could be located where desired.

A back frame extension 40 extends laterally outwardly from each side of the central portion of the back rest frame 16. The back frame extensions 40 as shown are identical to the seat frame extensions 24. In other embodiments, the back frame extensions 40 could be configured in other ways.

In an embodiment, the seat frame extensions 24 and/or back frame extensions 40 may be integral with the seat frame 14 and/or the back frame 16, respectively, rather than discrete elements.

A back frame bracket 32 is attached to each side rail 16S of the central portion of the back frame 16. Each back frame bracket 32, as shown, may include a forward web 32F, a rearward web 32R, and an intermediate web 32I. As illustrated, the back frame bracket 32 is the inverted mirror image of the seat frame bracket 30. In other embodiments, the back frame bracket 32 could have other configurations. A rear edge of the back frame bracket 32 runs generally parallel to the axial dimension of the side rail 16S. A flange 32FL may extend from the foregoing edge of the back frame bracket 32 so that the flange and adjoining portion of the back frame bracket "cradle" a corresponding portion of the side rail 16S.

Each arm rest 12 includes a forward portion 42 and a rearward portion 44. The forward portion 42 includes a lower rail 42L, an upper rail 42U and a pair of opposing left and right side rails 42S. The rearward portion 44 similarly includes a front rail 44F, a rear rail 44R and a pair of opposing left and right side rails 44S.

The rear rail 24R of each seat frame extension 24 is connected to the lower rail 42U of the forward portion 42 of the corresponding arm rest 12 by a first hinge 46. The first hinge 46 is configured so that a forward-facing side or surface of the forward portion 42 of the arm rest 12 may fold toward an upward-facing side or surface of the seat frame extension 24. The upper rail 42U of the forward portion 42 of the arm rest 12 is connected to the front rail 44F of the rearward portion 44 of the arm rest by a second hinge 48. The second hinge 48 is configured so that a rearward-facing side or surface of the forward portion 42 of the arm rest 12 may fold toward a downward-facing side or surface of the rearward portion 44 of the arm rest 12. The rear rail 44R of the rearward portion 44 of the arm rest 12 is connected to the lower rail 36L of the back frame extension 36 by a third hinge 50. The third hinge 50 is configured so that an upward-facing side or surface of the rearward portion 44 of the arm rest 12 may fold toward a forward-facing side or surface of the back frame extension 36.

Each of the hinges 46, 48, 50 is shown as a conventional hinge having first and second leaves joined in pivotal relationship by a hinge pin. In other embodiments, any suitable form of hinge could be used.

As best shown in FIGS. 4B and 5B, each seat frame bracket 30 is pivotally connected to a corresponding back frame bracket 32 via a first pivot pin PP1 at first pivot point P1. Each of the seat frame bracket 30 and back frame bracket 32 define a corresponding aperture for receiving the first pivot pin PP1. The first pivot point P1 is selected so that the seat frame 14 and the back frame 16 may lie generally (though not necessarily absolutely) flat or horizontal when the convertible sofa frame 10 is in the bed configuration. See FIGS. 5A and 5B. The first pivot point P1 also is selected so that the seat frame 14 and back frame 16 may be disposed generally (though not necessarily absolutely) perpendicular to each other when the convertible sofa frame 10 is in a sofa configuration to allow for a comfortable seating position. See FIGS. 1A and 1B (wherein the angle between the upward-facing side or surface of the seat frame 14 and the forward-facing side or surface of the back frame 16 is slightly greater than 90°).

Each seat frame bracket 30 and back frame bracket 32 is pivotally connected to a corresponding mounting bracket 52 through a corresponding linkage, as will be discussed further below. The mounting bracket 52 is shown as a structural angle having an elongated side flange 52S and an elongated base flange 52B generally perpendicular to the side flange. The side flange 52S defines a plurality of apertures for receiving pivot pins, as will be discussed further below. The base flange 52B defines a plurality of apertures for receiving fasteners (not shown) that may be used, for example, to secure the mounting bracket 52 to a structure, for example, the floor of a recreational vehicle. Frame supports 62 extend inwardly from the side flange 52S and/or base flange 52B of the mounting bracket 52. The frame supports 62 provide support for the seat frame 14 and back frame 16 when the seat frame 14 and/or back frame 16 are in a generally horizontal or flat orientation. For example, the seat frame 14 may rest upon the forward pair of frame supports 62 when the convertible sofa is in the sofa configuration or the bed configuration (but typically not when the convertible sofa is being reconfigured between these two configurations), and the back frame 16 may rest upon the frame supports 62 when the convertible sofa is in the bed configuration. The frame supports are shown is U-shaped channels but could be embodied in various other ways, for example, as bars or pins.

Each seat frame bracket 30 is pivotally connected by a second pivot pin PP2 at a second pivot point P2 to a first end of a corresponding first link 54. Each first link 54 is shown as dogleg-shaped (shaped like a splayed letter "V"), but it could have other shapes allowing for the placement of three apertures therein in a non-linear arrangement. The second end of each first link 54 is pivotally connected by a third pivot pin PP3 at a third pivot point P3 to the side flange 52S of the corresponding mounting bracket 52.

Each back frame bracket 32 is pivotally connected by a fourth pivot pin PP4 at a fourth pivot point P4 to a first end of a corresponding second link 56. Each second link 56 is shown as dogleg-shaped, but it could have other shapes allowing for the placement of three apertures therein in a non-linear arrangement. The second end of each second link 56 is pivotally connected by a fifth pivot pin PP5 at a fifth pivot point P5 to the side flange 52S of the corresponding mounting bracket 52.

Each first link 54 is pivotally connected to the corresponding second link via a corresponding third link 58. More specifically, a first end of each third link 58 is pivotally connected by a sixth pivot pin PP6 at a sixth pivot point P6 to the first link 54. As illustrated, the sixth pivot point P6 is located at or about the crux 54C of the dogleg of the first link 54. In other embodiments, the sixth pivot point P6 could be located at a suitable location not collinear with the second and third pivot points P2 and P3. The second end of each third link 58 is pivotally connected by a seventh pivot pin PP7 at a seventh pivot point P7 to the corresponding second link 56. As illustrated, the seventh pivot point P7 is located about midway between the fourth pivot point P4 and the crux 56C of the dogleg of the second link 56. In other embodiments, the seventh pivot point P7 could be located at another suitable location not collinear with the fourth and fifth pivot points P4 and P5.

In operation, the sofa frame 10 may be placed in a sofa configuration wherein the seat frame 12 and rearward portion 38 of the arm rest 12 are generally (though not necessarily absolutely) horizontal, and the back frame 16 and forward portion 36 of the arm rest 12 are generally (though not necessarily absolutely) vertical. See FIGS. 1A and 1B.

The sofa frame 10 may be converted to a bed configuration by lifting, pulling forward, and lowering the front end of the seat frame 12 through a sequence as shown, for example, in FIGS. 2A and 2B through FIGS. 5A and 5B, as discussed further below.

Figure 1A:
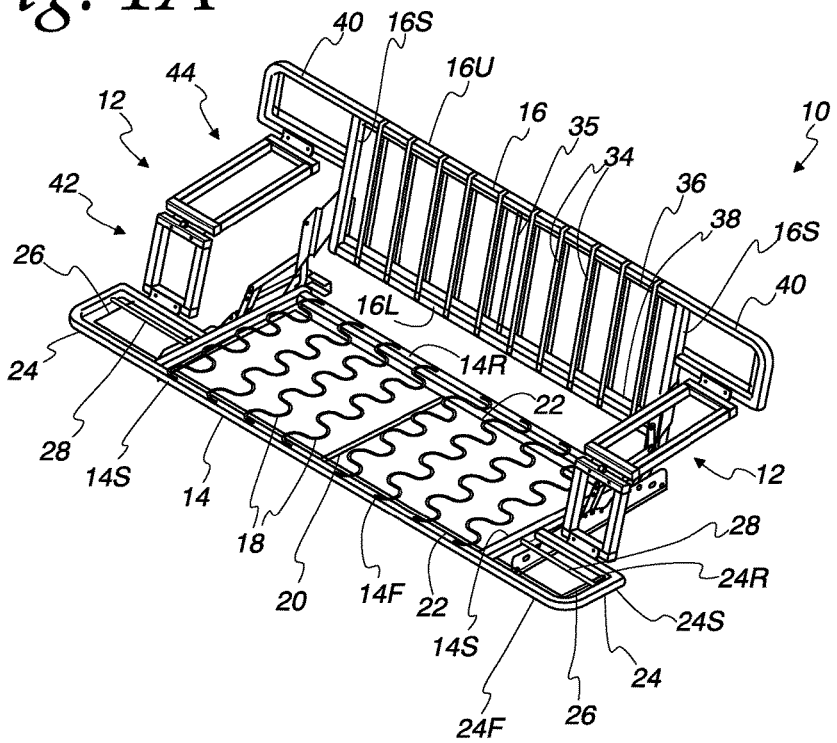
FIG. 1A is a perspective view of an illustrative convertible sofa frame in a sofa configuration.
Figure 1B:
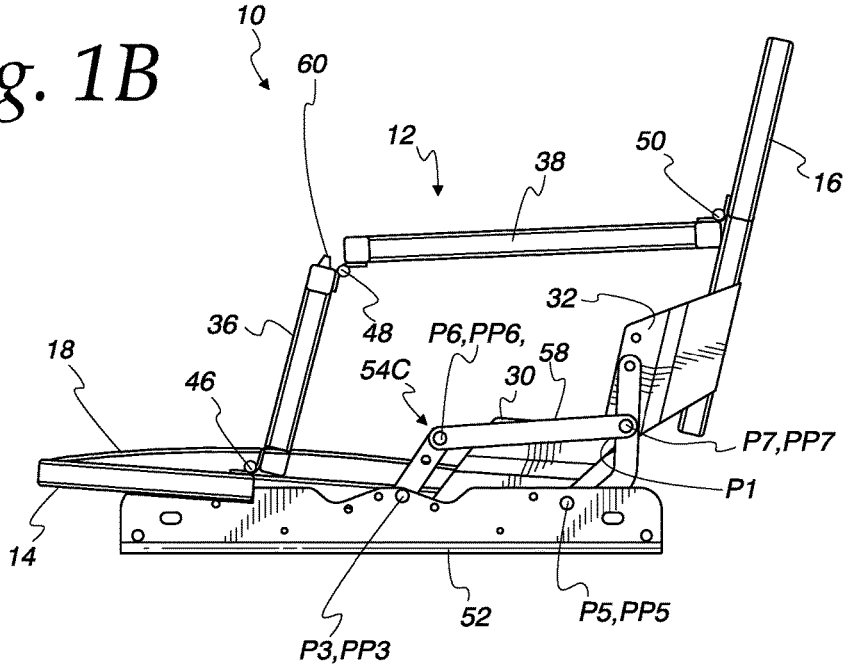
FIG. 1B is a side view of an illustrative convertible sofa frame in a sofa configuration.
Figure 2A:
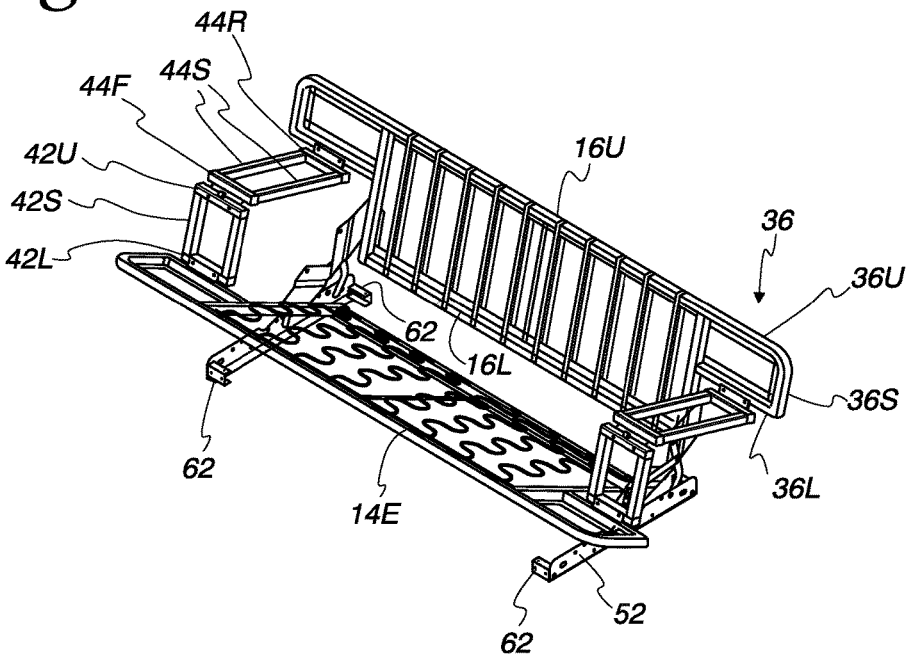
FIG. 2A is a perspective view of an illustrative convertible sofa frame in a first configuration intermediate a sofa configuration and a bed configuration.
Figure 2B:
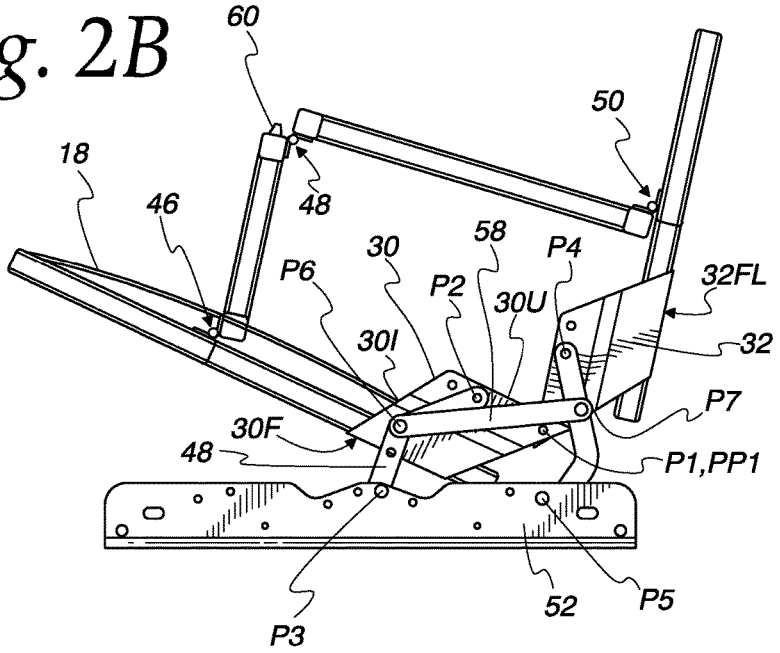
FIG. 2B is a side view of an illustrative convertible sofa frame in a first configuration intermediate a sofa configuration and a bed configuration.

In FIGS. 2A and 2B the forward portion of the seat frame 14 has been pulled forward and raised through an initial distance and arc compared to the configuration shown in FIGS. 1A and 1B. Consequently, (1) the upward facing side or surface of the seat frame 14 has been folded toward the forward-facing side or surface of the back frame 16, (2) the forward-facing side or surface of the forward portion of the arm rest 12 has been folded toward the upward-facing side or surface of the seat frame extension, (3) the rearward facing side or surface of the forward portion of the arm rest 12 has been folded toward the downward-facing side or surface of the rearward portion of the arm rest 12, (4) the upward-facing side or surface of the rearward portion of the arm rest 12 has been folded toward the forward-facing side or surface of the back frame extension, (5) and the first ends of the first and second links 54 and 56 have pivoted toward the front of the mounting bracket 52.

Figure 3A:
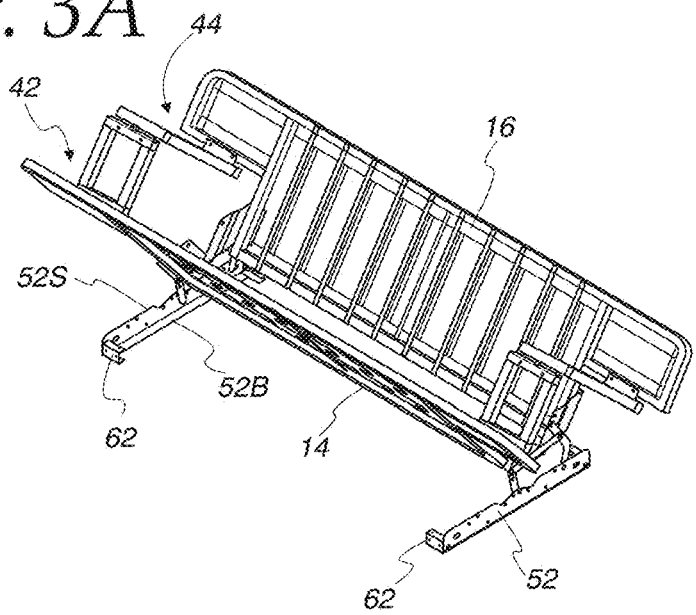
FIG. 3A is a perspective view of an illustrative convertible sofa frame in a second configuration intermediate a sofa configuration and a bed configuration.
Figure 3B:
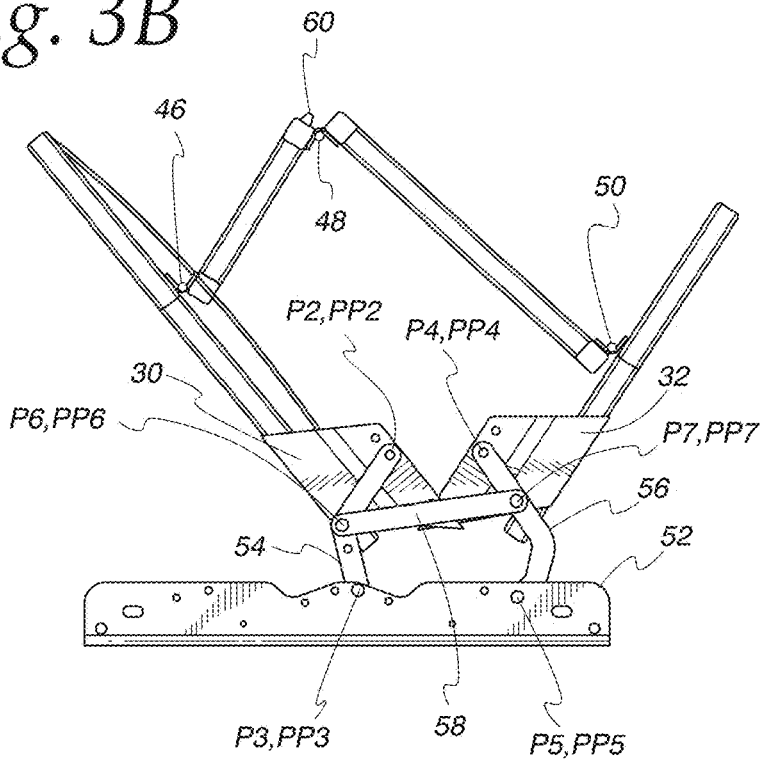
FIG. 3B is a side view of an illustrative convertible sofa frame in a second configuration intermediate a sofa configuration and a bed configuration.

In FIGS. 3A and 3B, the forward portion of the seat frame 14 has been pulled forward and raised through an additional distance and arc compared to the configuration shown in FIGS. 2A and 2B. Consequently, (1) the upward facing side or surface of the seat frame 14 has been folded further toward the forward-facing side or surface of the back frame 16, (2) the forward-facing side or surface of the forward portion of the arm rest 12 has been folded further toward the upward-facing side or surface of the seat frame extension, (3) the rearward facing side or surface of the forward portion of the arm rest 12 has been folded further toward the downward-facing side or surface of the rearward portion of the arm rest 12, (4) the upward-facing side or surface of the rearward portion of the arm rest 12 has been folded further toward the forward-facing side or surface of the back frame extension, (5) and the first ends of the first and second links 54 and 56 have pivoted further toward the front of the mounting bracket 52.

In FIGS. 4A and 4B, the forward portion of the seat frame 14 has been pulled further forward and lowered compared to the configuration shown in FIGS. 3A and 3B. Consequently, (1) the upward facing side or surface of the seat frame 14 has been unfolded away from the forward-facing side or surface of the back frame 16, (2) the forward-facing side or surface of the forward portion of the arm rest 12 has been unfolded away from the upward-facing side or surface of the seat frame extension, (3) the rearward facing side or surface of the forward portion of the arm rest 12 has been unfolded away from the downward-facing side or surface of the rearward portion of the arm rest 12, (4) the upward-facing side or surface of the rearward portion of the arm rest 12 has been unfolded away from the forward-facing side or surface of the back frame extension, (5) and the first ends of the first and second links 54 and 56 have pivoted further toward the front of the mounting bracket 52.

In FIGS. 5A and 5B, the forward portion of the seat frame 14 has been pulled further forward and further lowered compared to the configuration shown in FIGS. 4A and 4B. Consequently, (1) the upward facing side or surface of the seat frame 14 has been unfolded further away from the forward-facing side or surface of the back frame 16, (2) the forward-facing side or surface of the forward portion of the arm rest 12 has been unfolded further away from the upward-facing side or surface of the seat frame extension, (3) the rearward facing side or surface of the forward portion of the arm rest 12 has been unfolded further away from the downward-facing side or surface of the rearward portion of the arm rest 12, (4) the upward-facing side or surface of the rearward portion of the arm rest 12 has been unfolded further away from the forward-facing side or surface of the back frame extension, (5) and the first ends of the first and second links 54 and 56 have pivoted further toward the front of the mounting bracket 52. In the FIGS. 5A and 5B configuration, all of the seat frame 14, the back frame 16, the forward portion of the arm rest 12, and the rearward portion of the arm rest 12 are in a generally (though not necessarily absolutely) flat or horizontal configuration. In an embodiment, at least the seat frame 14 and the back frame 16 may be in an absolutely flat or horizontal configuration when the convertible sofa frame 10 is in the bed configuration.

The convertible sofa frame 10 can be converted from the bed configuration of FIGS. 5A and 5B to the sofa configuration of FIGS. 1A and 1B through a reverse procedure.

A bumper 60 may be provided at the rear of the forward portion 42 of the arm rest 12 or the front of the rearward portion 44 of the arm rest. The bumper 60 may be configured to bias apart the forward and rearward portions 42, 44 of the arm rest 12 when the convertible sofa frame is in the bed configuration to preclude "locking" of the forward and rearward portions of the arm rest. As such, the bumper 60 may aid in transitioning the forward and rearward portions 42, 44 of the arm rest 12 from the "flat" configuration to the "arm rest" configuration when the convertible sofa 10 is transitioned from the bed configuration to the sofa configuration. Bumper 60 may be a resilient structure, for example, a resilient rubber structure or a spring. In other embodiments, the bumper 60 may be omitted. In further embodiments, another form of biasing mechanism may be provided in place of or in addition to the bumper 60. For example, a torsion spring (not shown) may be provided in connection with the pivotal connection between the front portion of the arm rest and the rear portion of the armrest and configured to bias the front portion of the arm rest and the rear portion of the armrest away from their configuration when the convertible sofa frame is in the bed configuration.

Figure 12:
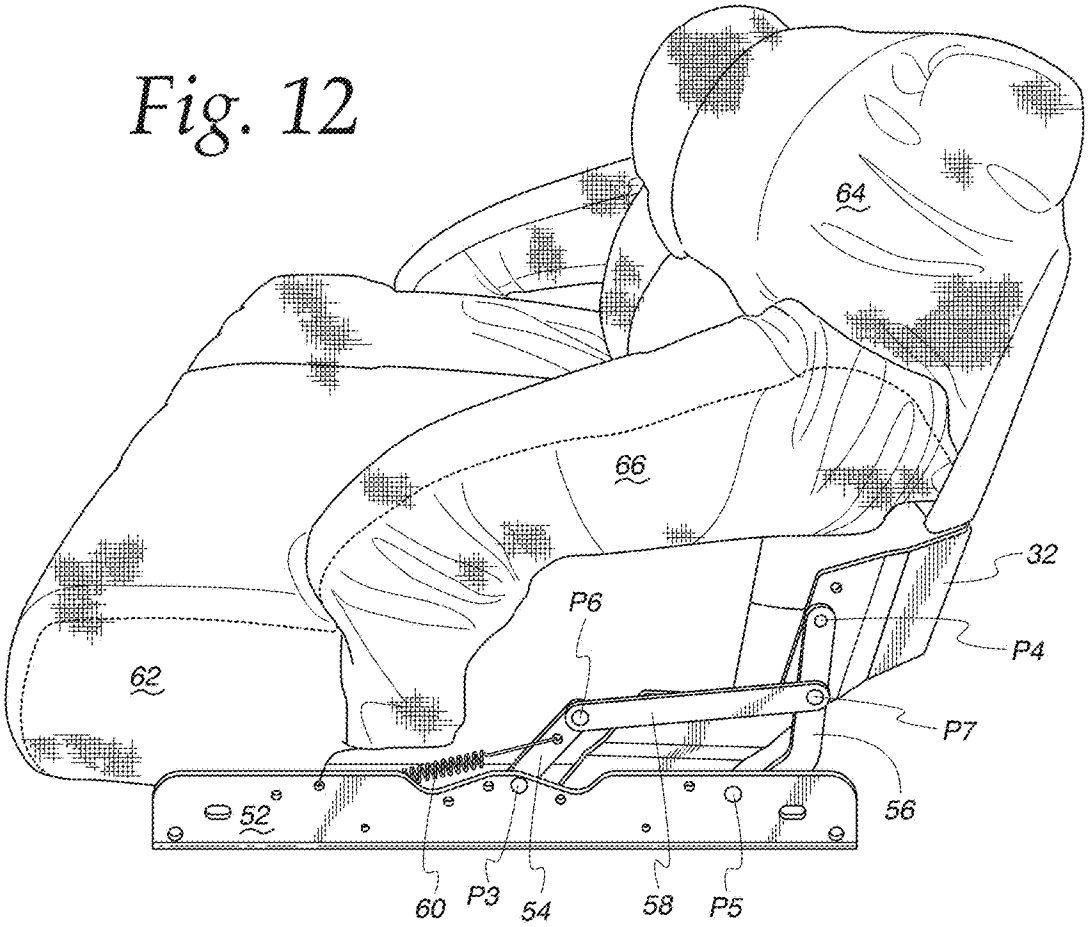
FIG. 12 is a view of an illustrative convertible sofa frame in a sofa configuration and with cushions attached thereto.

As shown in FIG. 12, a biasing mechanism, for example, a spring 60 connected between the mounting bracket 52 and the first link 54, may be provided to assist a user in pulling the seat frame 14 forward with respect to the mounting bracket 52, for example, when reconfiguring the convertible sofa frame 10 from the sofa configuration to the bed configuration, as described above. A similar biasing mechanism may be provided in connection with the convertible sofa frame 10.

Figure 13:
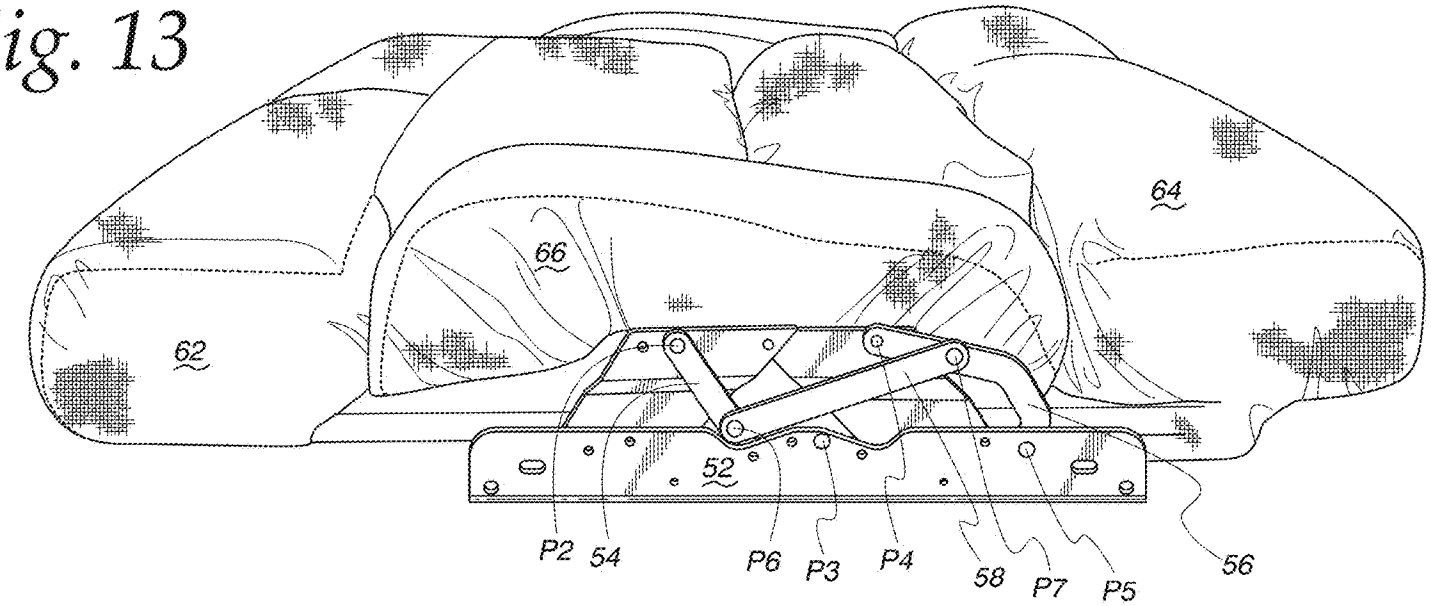
FIG. 13 is a view of an illustrative convertible sofa frame in a bed configuration and with cushions attached thereto.

As shown in FIGS. 12 and 13, cushions 62, 64, 66 may be provided atop the seat frame 14 (and extensions 24 thereof), the back frame 16 (and extensions 40 thereof), and the arm rests 12 of the convertible sofa frame 10. Any or all of cushions could be made of ticking or a resilient foam material.

Figure 7A:
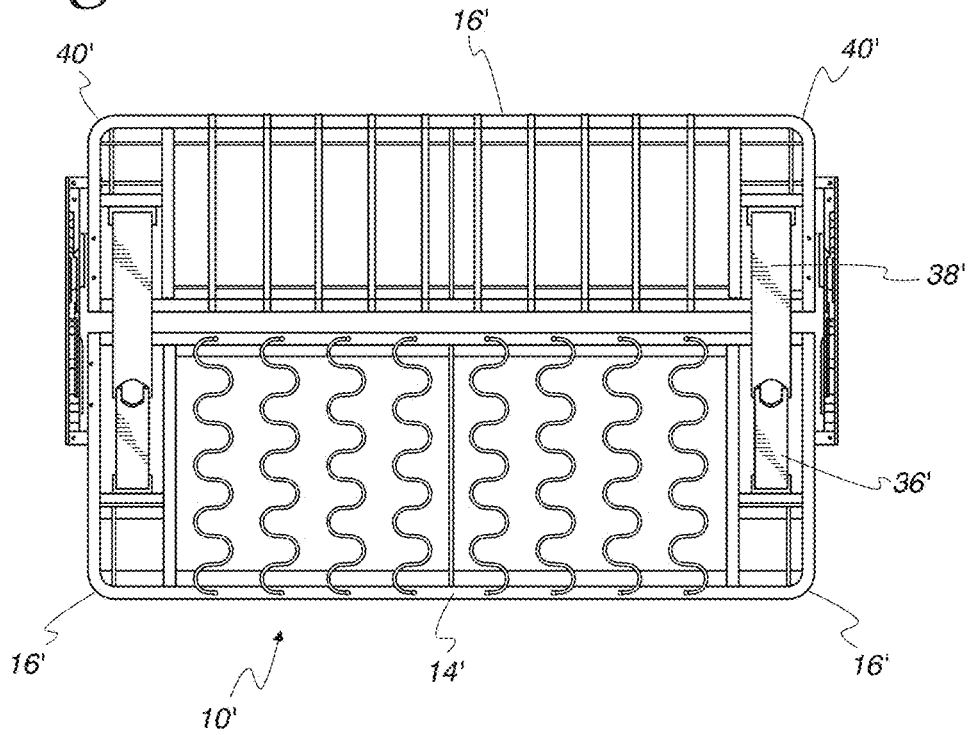
FIG. 7A is a top plan view of another illustrative convertible sofa frame in a bed configuration.
Figure 7B:
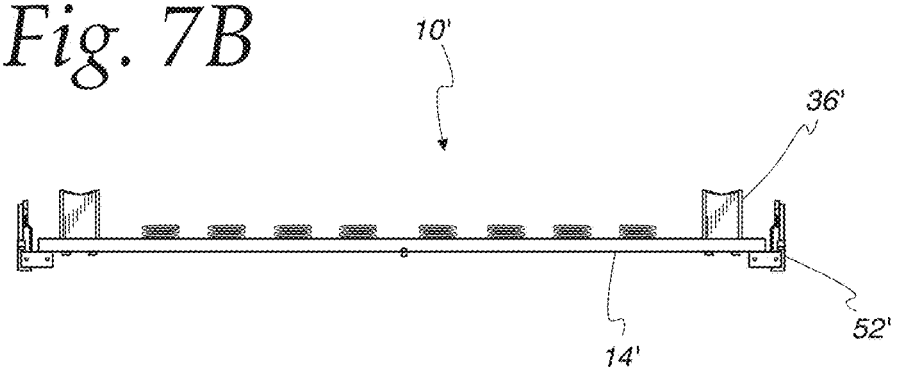
FIG. 7B is a front elevation view of another illustrative convertible sofa frame in a bed configuration.
Figure 7C:
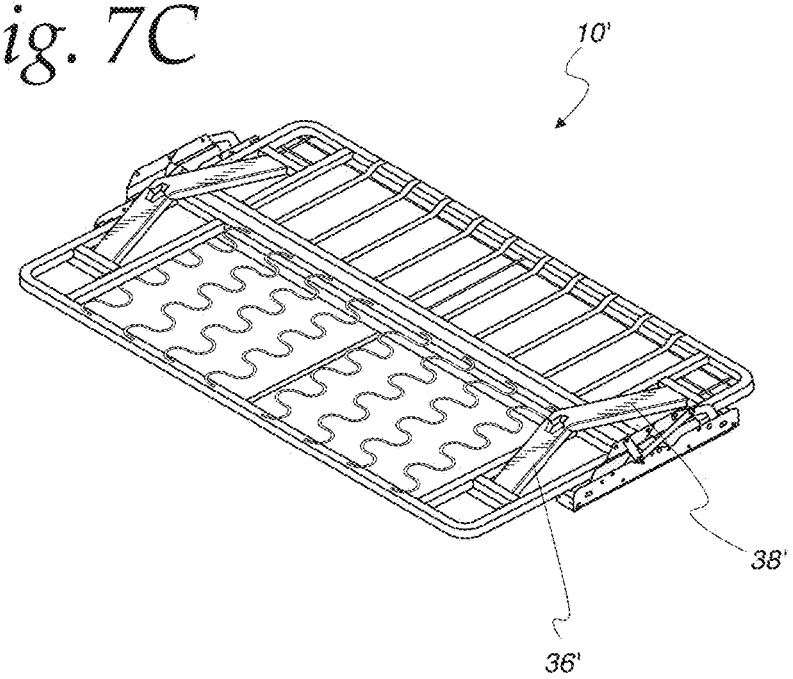
FIG. 7C is a perspective view of another illustrative convertible sofa frame in a bed configuration.
Figure 7D:
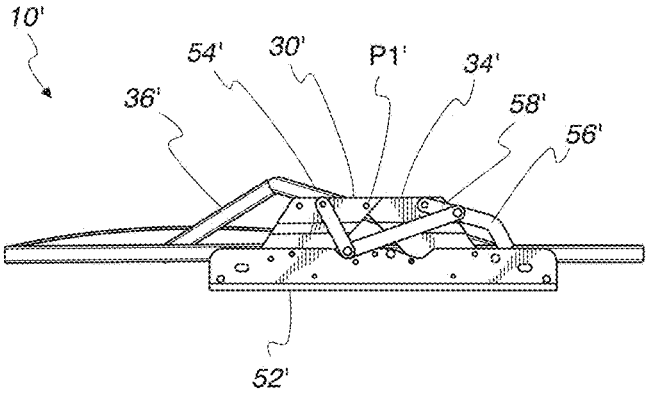
FIG. 7D is an end elevation view of another illustrative convertible sofa frame in a bed configuration.
Figure 8A:
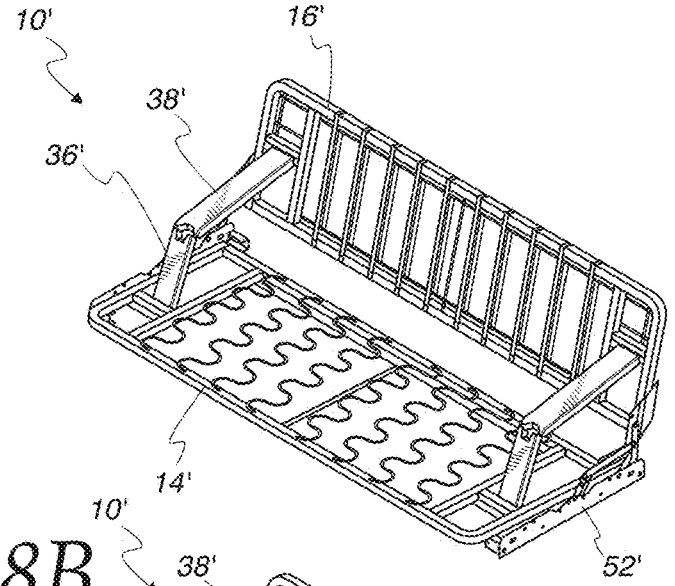
FIGS. 8A-8E, respectively are perspective views of another illustrative convertible sofa frame in a sofa configuration, a first configuration intermediate a sofa configuration and a bed configuration, a second configuration intermediate a sofa configuration and a bed configuration, a third configuration intermediate a sofa configuration and a bed configuration, and a bed configuration.
Figure 8B:
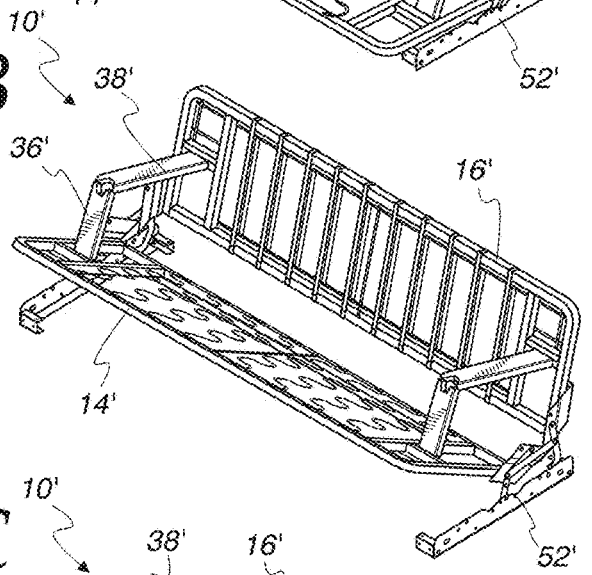
Figure 8C:
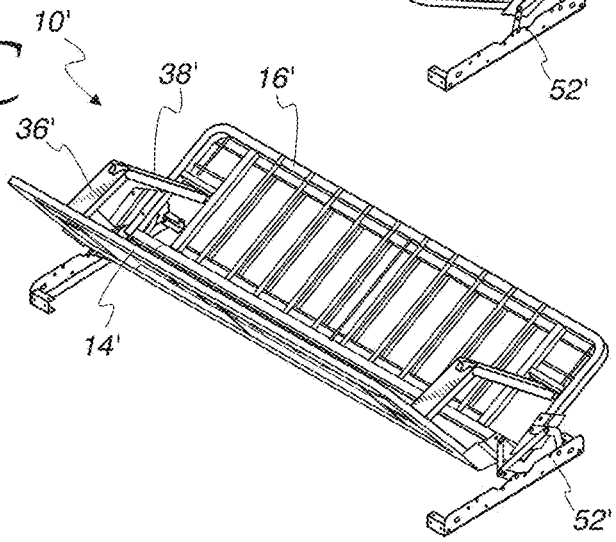
Figure 8D:
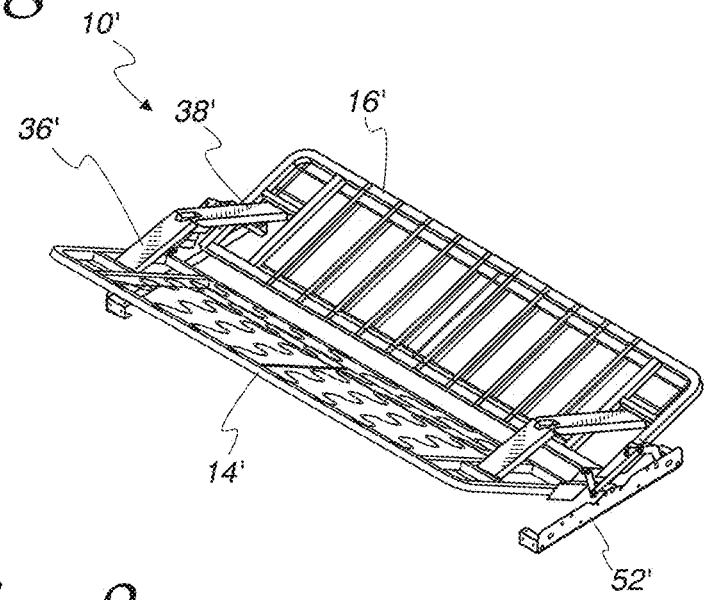
Figure 8E:
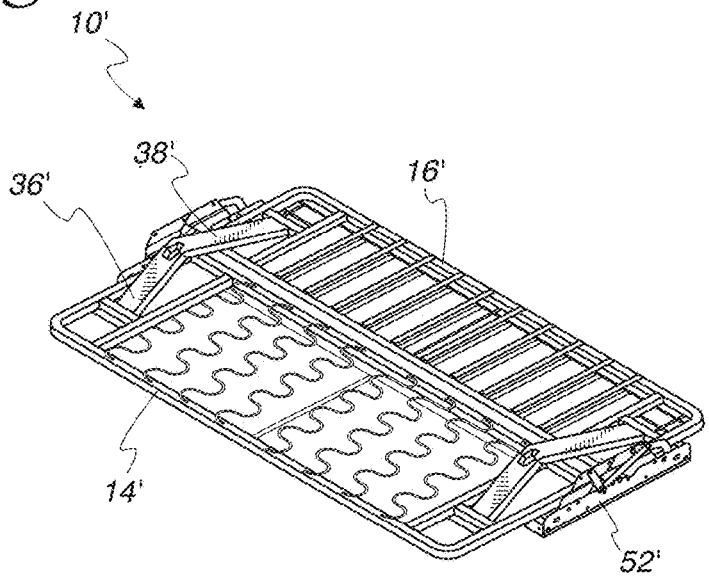
Figure 9A:
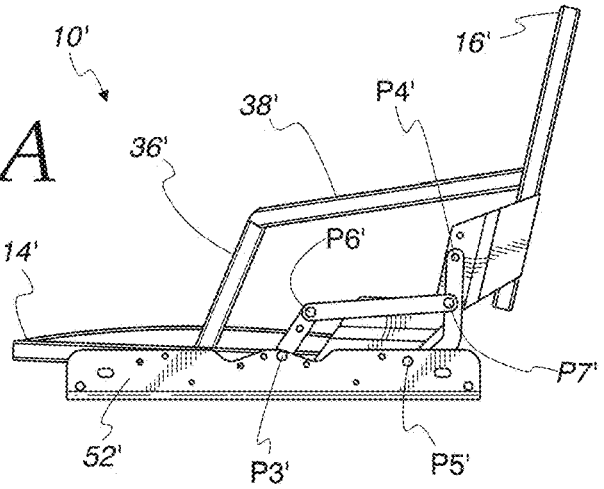
FIGS. 9A-9E, respectively are end elevation views of another illustrative convertible sofa frame in a sofa configuration, a first configuration intermediate a sofa configuration and a bed configuration, a second configuration intermediate a sofa configuration and a bed configuration, a third configuration intermediate a sofa configuration and a bed configuration, and a bed configuration.
Figure 9B:
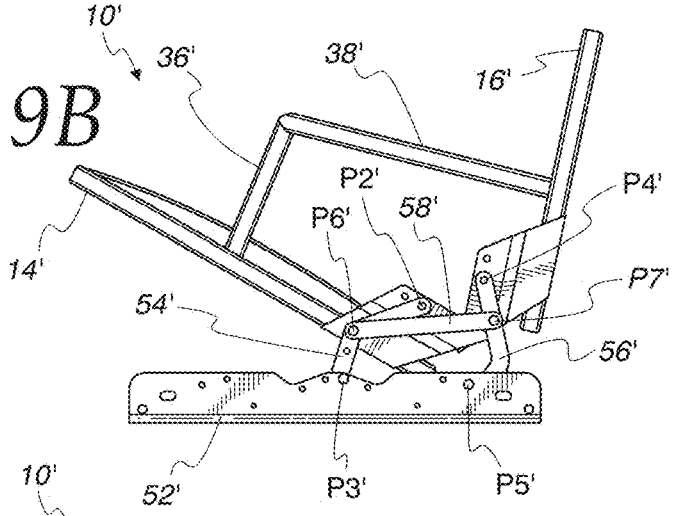
Figure 9C:
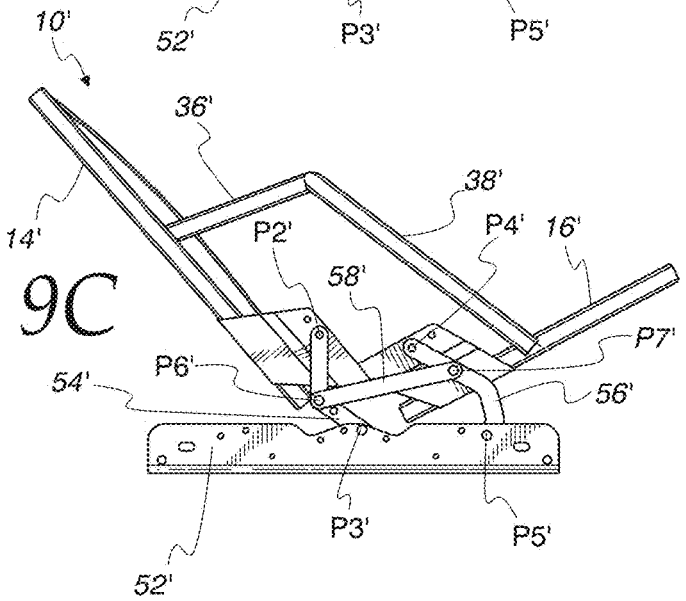
Figure 9D:
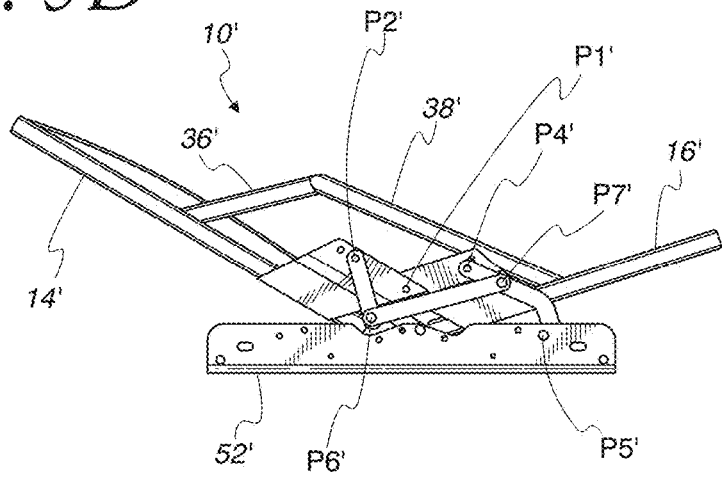
Figure 9E:
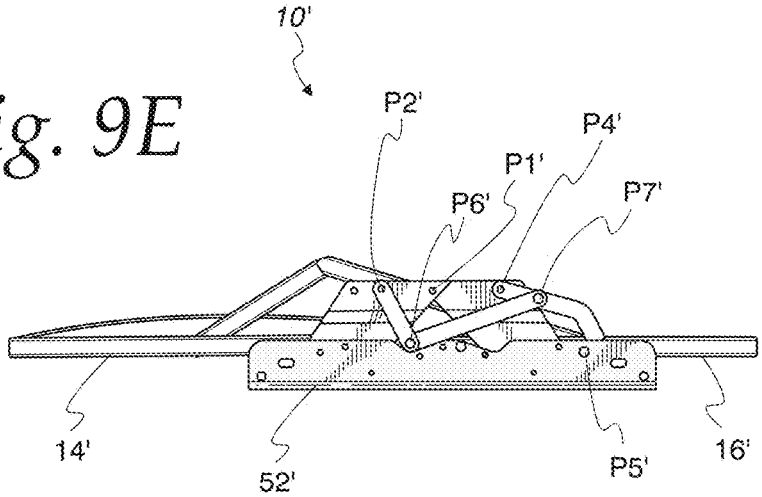
Figure 14:
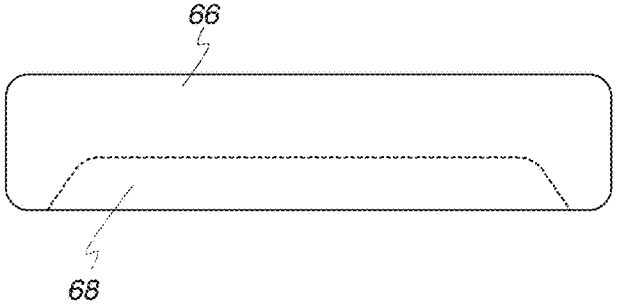
FIG. 14 is a side elevation view of a cushion for an illustrative convertible sofa frame.

As shown in FIG. 14, the underside of the cushions 66 atop the arm rests 12 (that is, the side of the cushions 66 abutting or adjacent to the arm rests) may be formed to accommodate portions of the arm rests that may extend above the plane of the upper surface of the seat frame 14 and the forward surface of the back frame 16 when the convertible sofa frame 10 is in the bed configuration, as suggested in FIG. 5B (and in FIG. 7D, discussed below). For example, the underside of the cushions 66 could be partially hollowed out or formed to define a cavity 68 receiving such portions of the arm rests 12.

The cushions 62, 64 could be formed to define one or more cavities similar to the cavity 68 of the cushion 66 as might be necessary or desired to accommodate any portion of the seat frame 14 and/or back frame 16 that might extend above the plane of the upper surface of the seat frame 14 and the forward surface of the back frame 16 when the convertible sofa frame 10 is in the bed configuration.

Also, the cushions 62, 66 could be tapered from front-to-back (that is, in a direction from the front of the convertible sofa frame toward the rear of the convertible sofa frame) to counter a less-than-horizontal orientation of the seat frame 14 and/or back frame 16 when the convertible sofa frame 10 is in the bed configuration.

In an embodiment, two or more of the cushions 62, 64, 66 could be embodied as a single cushion covering two or more of the seat frame 14, the back frame 16, and the arm rests 12. Also, any or all of the cushions 62, 64, 66 could be embodied as a plurality of cushions.

FIGS. 6A-9E show another illustrative convertible sofa frame 10'. The convertible sofa frame 10' is similar in structure and operation to the convertible sofa frame 10. Features of the convertible sofa frame 10' having analogous counterparts in the convertible sofa frame 10 may be identified in the drawings by similar, primed reference characters. For example, the convertible sofa frame 10' includes a seat frame 12' analogous to the seat frame 10 of the convertible sofa frame 10. Although the convertible sofa frame 10' is similar in structure and operation to the convertible sofa frame 10 in many regards, the two differ as follows.

The seat frame extensions 24' of the convertible sofa frame 10' are shown as extending from the front rail 14F' to the rear rail 14R' of the seat frame 14' thereof, whereas the seat frame extensions 24 of the convertible sofa frame 10 are shown as extending from the front rail 14F of the seat frame 14 to a point forward of the forward portion 36 of the corresponding arm rest 12. Similarly, the back frame extensions 40' of the convertible sofa frame 10' extend from the upper rail 16U' to the lower rail 16L' thereof, whereas the back frame extensions 40 of the convertible sofa frame 10 are shown as extending from the upper rail 16U of the back frame 16' to a point upward of the rearward portion 38 of the corresponding arm rest 12. The seat frame extensions 24' and back frame extensions 40' of the convertible sofa frame 10' may be integral with the seat frame 14' and back frame 16' thereof, rather than discrete elements.

Consequently, the pivot mechanisms or linkages (including the first link 54', the second link 56', and the third link 58') connecting the seat frame 14' to the back frame 16' of the convertible sofa frame 10' are outboard of the respective arm rests 12', whereas the corresponding pivot mechanisms or linkages (including the first link 54, the second link 56, and the third link 58) of the convertible sofa frame 10 are inboard of the respective arm rests 12.

Also, the forward portions 36' of the arm rests 12' of the convertible sofa frame 10' are embodied as structural channels, each having a web 36W and opposing parallel flanges 36F extending in the same direction from opposite sides of the web, whereas the forward portions 36 of the arm rests 12 of the convertible sofa frame 10 are embodied as space frames made of tubular structures. The rearward portions 38' of the arm rests 12' of the convertible sofa frame 10' are similarly embodied as structural channels, each having a web 38W and opposing parallel flanges 38F extending in the same direction from opposite sides of the web.

Further, the forward portions 36' of the arm rests 12' and the rearward portions 38' of the arm rests of the convertible sofa frame 10' are interconnected by pivot pins 56PP extending through apertures (not shown) defined by the corresponding flanges 36W, 38W thereof near the adjoining ends thereof, whereas the corresponding portions of the convertible sofa frame 10 are connected by leaf-type hinges. As shown, the flanges of the forward end of the rearward portion 38' of the arm rest 12' overlap the flanges of the rearward end of the forward portion 36' of the arm rest 12'. In another embodiment, the flanges of the rearward end of the forward portion 36' of the arm rest 12' could overlap the flanges of the forward end of the rearward portion 38' of the arm rest 12'.

Moreover, the rearward portions 38' of the arm rests 12' of the convertible sofa frame 10' are connected to the back frame 16' thereof by pivot pins extending through the flanges of the rearward portions of the arm rests and corresponding brackets mounted to the back frame, whereas the rearward portions of the arm rests of the convertible sofa frame 10 are connected to the back frame extensions 40 thereof by leaf-type hinges. The forward portions 36' of the arm rests 12' are pivotally connected to the seat frame 14' of the convertible sofa frame 10' in a similar manner.

The convertible sofa frame 10' is operable in the same manner as the convertible sofa frame 10.

The convertible sofa frame 10' may be provided with cushions similar to the cushions 62, 62, 66 described above in connection with the convertible sofa frame 10.

The embodiments shown and described herein are illustrative and are not to be construed to limit the scope of the appended claims. Features shown a given embodiment may be included in another embodiment to the extent possible.

The invention claimed is:

1. A convertible sofa frame, comprising:
- a mounting bracket;
- a seat frame;
- a back frame pivotally connected to said seat frame at a first pivot point and no intervening pivot point;
- a linkage connecting said seat frame and said back frame to said mounting bracket, said linkage comprising:
  - a first link defining a second pivot point, a third pivot point, and a sixth pivot point, said sixth pivot point not co-linear with said second pivot point and said third pivot point, said first link pivotally connected to said seat frame at said second pivot point and pivotally connected to said mounting bracket at said third pivot point;
  - a second link defining a fourth pivot point, a fifth pivot point, and a seventh pivot point, said seventh pivot point not co-linear with said fourth pivot point and said fifth pivot point, said second link pivotally connected to said back frame at said fourth pivot point and pivotally connected to said mounting bracket at said fifth pivot point; and
  - a third link pivotally connected to said first link at said sixth pivot point and pivotally connected to said second link at said seventh pivot point; and
- an arm rest having a first portion and a second portion, said first portion pivotally connected to said back frame and to said second portion, and said second portion pivotally connected to said first portion and to said seat frame.

2. The convertible sofa frame of claim 1 reconfigurable between a first configuration wherein said seat frame and said back frame are in a first angular relationship with respect to each other, said first angular relationship defining a first included angle between said seat frame and said back frame, and a second configuration wherein said seat frame and said back frame are in a second angular relationship with respect to each other, said second angular relationship defining a second included angle between said seat frame and said back frame.

3. The convertible sofa frame of claim 2 wherein said first included angle is smaller than said second included angle.

4. The convertible sofa frame of claim 2 wherein said first portion of said armrest and said second portion of said armrest are in a third angular relationship with respect to each other when said convertible sofa frame is in said first configuration, said third angular relationship defining a third included angle between said first portion of said armrest and said second portion of said armrest, and wherein said first portion of said armrest and said second portion of said armrest are in a fourth angular relationship with respect to each other when said convertible sofa frame is in said second configuration, said fourth angular relationship defining a fourth included angle between said first portion of said armrest and said second portion of said armrest.

5. The convertible sofa frame of claim 4 further comprising:

a seat frame bracket connected to said seat frame; and a back frame bracket connected to said back frame, said seat frame bracket pivotally connected to said back frame bracket.

6. The convertible sofa frame of claim 5, wherein at least one of said seat frame bracket and said back frame bracket comprises a first portion, a second portion parallel to and offset from said first portion, and an intermediate portion connecting said first portion and said second portion.

7. The convertible sofa frame of claim 6, wherein said at least one of said seat frame bracket and said back frame bracket further comprises a flange extending from said first portion or said second portion.

8. The convertible sofa frame of claim 4 wherein each of said first portion of said arm rest and said second portion of said arm rest comprises a generally rectangular structure.

9. The convertible sofa frame of claim 8 wherein said generally rectangular structure comprises first and second opposed and parallel side rails and first and second opposed and parallel end rails connected to said first and second side rails.

10. The convertible sofa frame of claim 8 wherein said generally rectangular structure comprises a generally rectangular channel having a generally rectangular web and first and second flanges extending from said generally rectangular web.

11. The convertible sofa frame of claim 2 further comprising a frame support extending from said mounting bracket, said frame support configured to support a portion of said seat frame when said convertible sofa frame is in said first configuration.

12. The convertible sofa frame of claim 4 further comprising:

a second mounting bracket; and a second linkage connecting said seat frame and said back frame to said second mounting bracket;

said seat frame, said linkage, and said second linkage disposed between said mounting bracket and said second mounting bracket.

13. The convertible sofa frame of claim 4 further comprising a biasing mechanism configured to bias said first portion of said arm rest and said second portion of said arm rest away from said fourth angular relationship.

14. The convertible sofa frame of claim 13 wherein said biasing mechanism comprises a resilient bumper disposed between an end of said first portion of said arm rest and an end of said second portion of said arm rest.

15. The convertible sofa frame of claim 1 further comprising a cushion covering said arm rest.

16. The convertible sofa frame of claim 15 wherein said cushion covering said arm rest defines a cavity extending inwardly from an underside thereof.

17. The convertible sofa frame of claim 15 further comprising a second cushion covering one or both of said seat frame and said back frame.

* * * * *